United States Patent [19]

Mishcon, deceased et al.

[11] 4,144,726

[45] Mar. 20, 1979

[54] WIPER CONTROL MECHANISM FOR A CIRCULAR KNITTING MACHINE

[75] Inventors: Lester Mishcon, deceased, late of Miami Beach, Fla., by Martha Mishcon, executrix; Harry Agulnek, Miami Beach, Fla.

[73] Assignee: Vanguard Supreme Machine Corp., Monroe, N.C.

[21] Appl. No.: 833,197

[22] Filed: Sep. 14, 1977

[51] Int. Cl.[2] ..... D04B 15/60

[52] U.S. Cl. ..... 66/140 R

[58] Field of Search ..... 66/138, 140 R, 145 R

[56] References Cited

U.S. PATENT DOCUMENTS

| | | | |
|---|---|---|---|
| 1,951,842 | 3/1934 | Robinson | 66/140 R |
| 2,543,121 | 2/1951 | Mishcon et al. | 66/138 |
| 2,549,701 | 4/1951 | Mishcon et al. | 66/140 R |
| 4,033,150 | 7/1977 | Mishcon et al. | 66/138 |

FOREIGN PATENT DOCUMENTS

| | | | |
|---|---|---|---|
| 707985 | 4/1954 | United Kingdom | 66/145 R |
| 1128713 | 10/1968 | United Kingdom | 66/138 |

*Primary Examiner*—Wm. Carter Reynolds

*Attorney, Agent, or Firm*—Bell, Seltzer, Park & Gibson

[57] ABSTRACT

The wipers of yarn cutting and clamping devices associated with the striping boxes of a circular knitting machine are controlled according to the position of a pivoted cam which is mounted in a member affixed to a rotatable sinker dial and is operable between a wiper actuating position and non-actuating position.

3 Claims, 12 Drawing Figures

Fig. 3
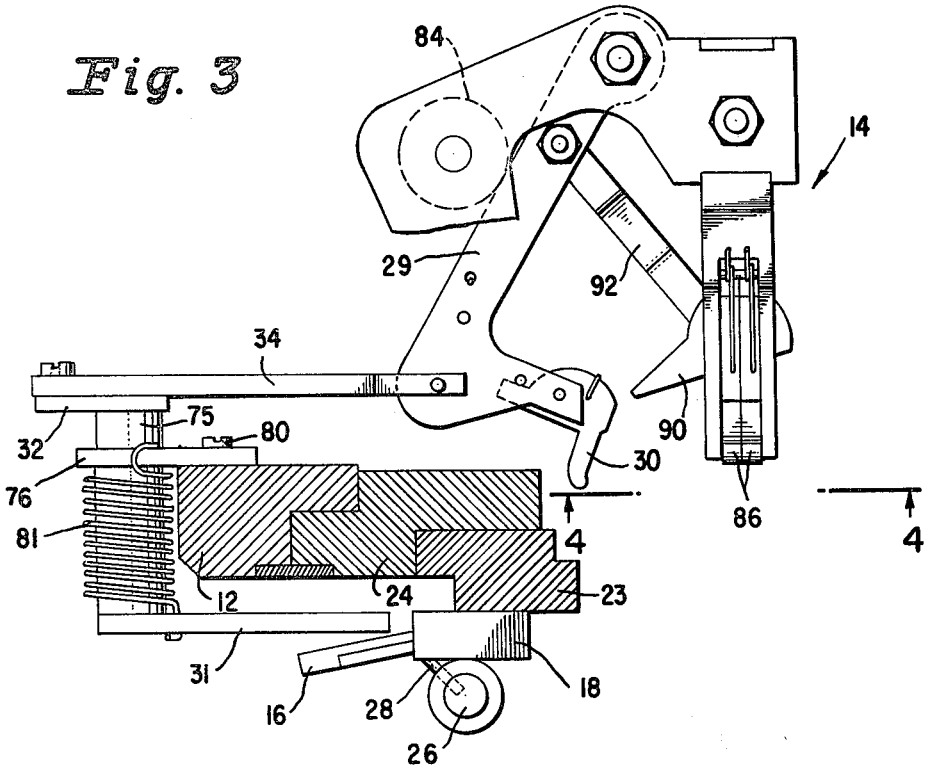
Fig. 4
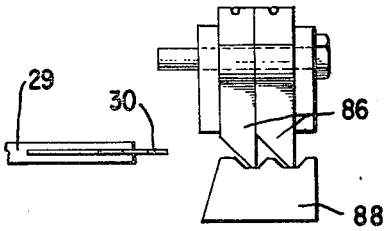
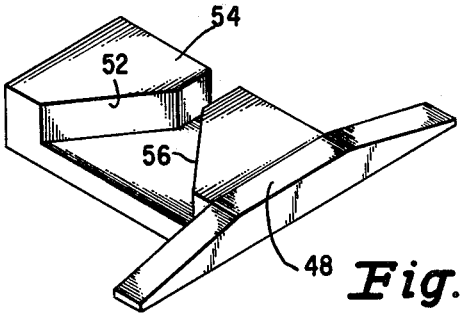
Fig. 5

Fig. 6
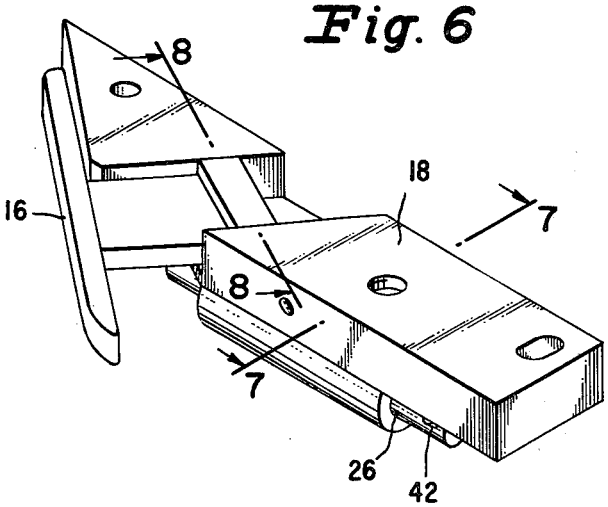
Fig. 7
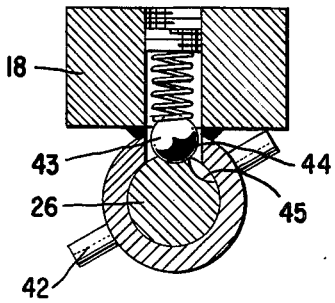
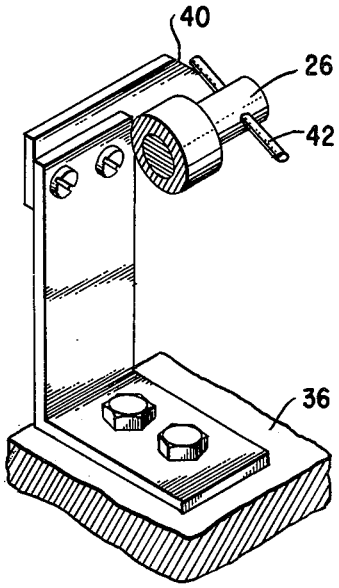
Fig. 10
Fig. 9
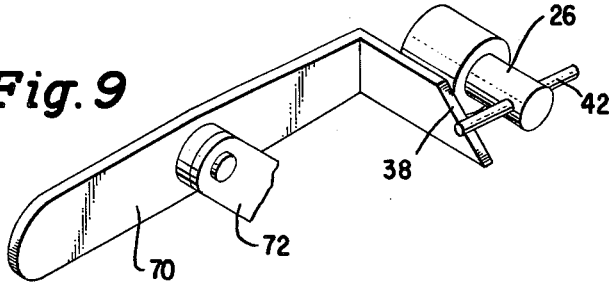
Fig. 8
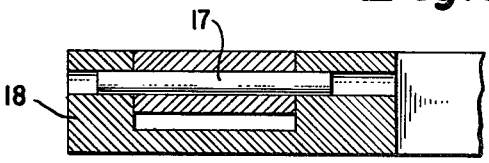
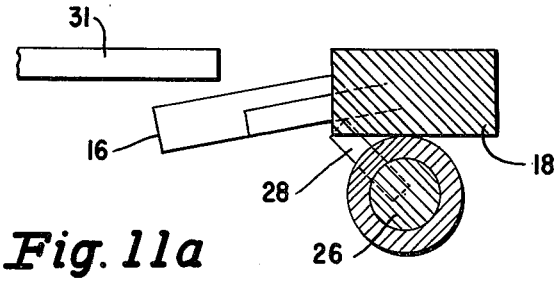
Fig. 11a
Fig. 11
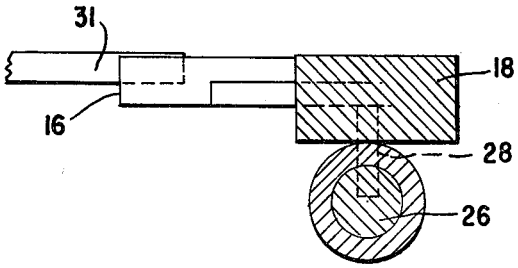

WIPER CONTROL MECHANISM FOR A CIRCULAR KNITTING MACHINE

BACKGROUND OF THE INVENTION

1. Field of the Invention

The invention relates to circular knitting machines and especially to circular knitting machines adapted to knit striped fabric.

2. Description of the Prior Art

Circular knitting machines which are adapted to produce striped fabric and include striping boxes with selectively operable yarn changing fingers are provided with devices for cutting and clamping a discontinued yarn whenever a yarn change is made. Such a knitting machine is shown and described in U.S. Pat. No. 2,549,701 of S. Mishcon et al for "Apparatus for Knitting Striped Fabric" issued Apr. 17, 1951.

A difficulty has been experienced with such machines in that the wipers of the yarn cutting and clamping devices have behaved erratically. Whenever a striping box in these machines is actuated, an associated wiper finger is released from a locked position for actuation by a cam affixed to a rotatable sinker ring. Such cam causes the wiper finger to be pushed through and beyond yarn clamps where the wiper finger is supposed to be retained by a locking arrangement, as shown in the said U.S. Pat. No. 2,549,701, until again released for actuation upon operation of the striping box. The locking arrangement, however, hasn't always performed reliably, since it has sometimes permitted the wiper finger to be released during periods of inactivity of the striping box extending over a number of revolutions of the sinker ring relative thereto, and the wiper finger to be repeatedly actuated unnecessarily by the cam affixed to the sinker ring. Such unnecessary actuations of the wiper finger has often caused yarn either to be removed from the clamps or repeatedly lengthened by the action of the finger until it became entangled with the needles of the machine.

SUMMARY OF THE INVENTION

In accordance with the invention, the locking arrangement previously provided in yarn cutting and clamping devices is eliminated and a pivoted cam is provided on the sinker dial of the machine to control the wiper finger. Such pivoted cam moves into a wiper actuating position only when engaged by a cam operated by the plunger of a striping box at a first feed on the machine and moves into a neutral non-actuating position when actuated by a fixed cam located between the last and said first feed. Whenever actuated by the pivoted cam, the wiper finger is caused to move inwardly and through and then to move outwardly and over the clamps where it remains until reactivated by the pivoted cam.

DESCRIPTION OF THE DRAWINGS

FIG. 3 is a vertical sectional view taken on the plane of the line 3—3 of FIG. 1;

FIG. 4 is a fragmentary view taken on the plane of the line 4—4 of FIG. 3;

FIG. 5 is a perspective view of a rotatable plunger actuating cam;

FIG. 6 is a perspective view showing the pivoted cam of the invention;

FIG. 7 is a cross-sectional view taken on the plane of the line 7—7 of FIG. 6;

FIG. 8 is a sectional view taken on the plane of line 8—8 of FIG. 6;

FIG. 9 is perspective view of a plunger operated cam;

FIG. 10 is a perspective view of a fixed neutralizing cam;

FIGS. 11 and 11*a* are somewhat diagrammatic sectional views taken on the plane of line 11—11 of FIG. 1 and showing the pivoted cam engageable with wiper linkage in an actuating and non-actuating position respectively.

DESCRIPTION OF THE PREFERRED EMBODIMENT OF THE INVENTION

Figure 1:
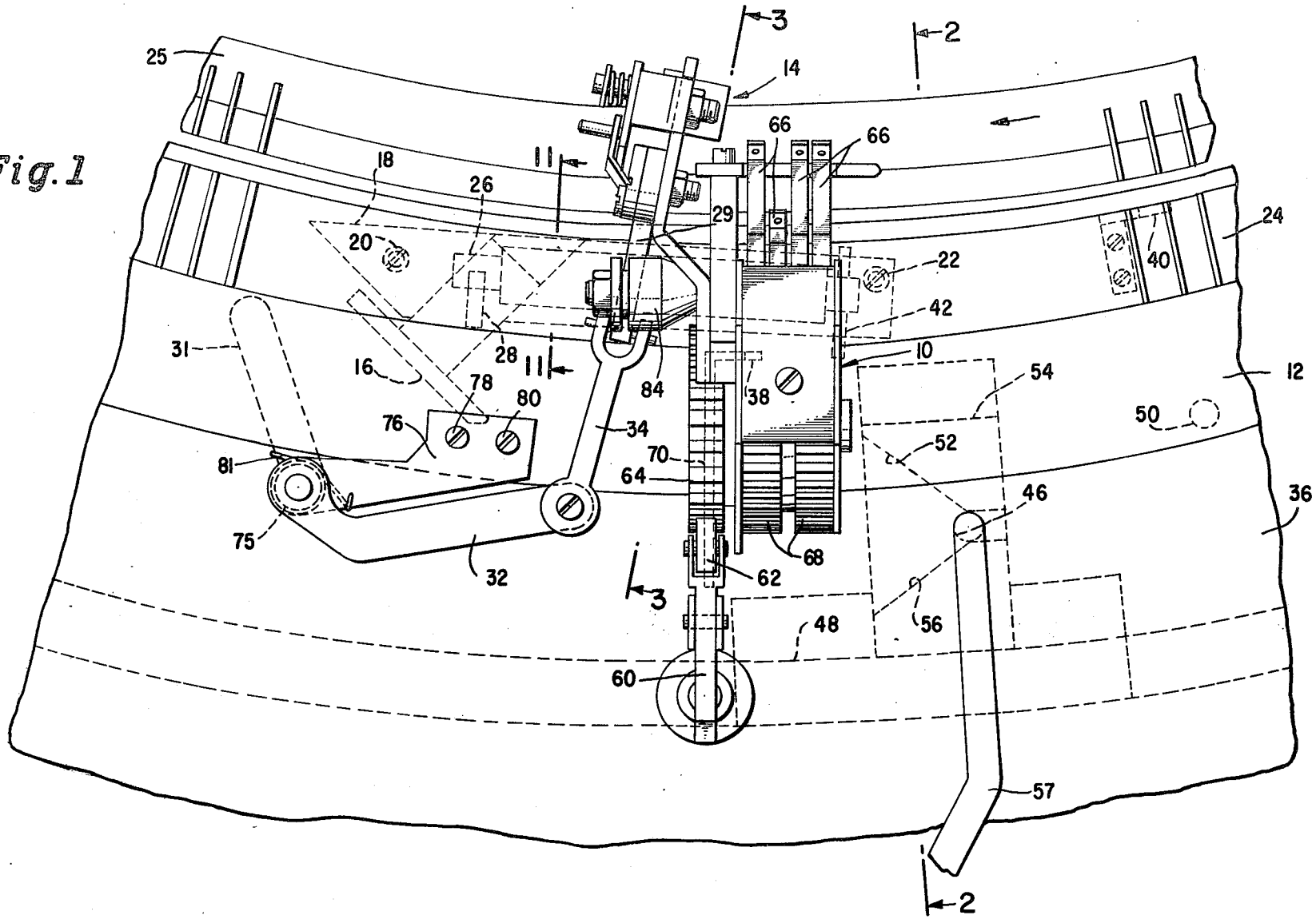
FIG. 1 is a fragmentary top plan view showing wiper control mechanism according to the invention.

Referring to the drawings, and in particular to FIG. 1, reference character 10 designates a striping box mounted on the striping box carrier ring 12 of a circular knitting machine for producing striped fabric. Such striping box has a yarn cutting and clamping device 14 affixed to it. The striping box 10 and the yarn cutting and clamping device 14 are of the kinds shown in U.S. Pat. No. 2,549,701. However, the yarn cutting and clamping device is controlled in accordance with the invention to prevent faulty operation.

Figure 2:
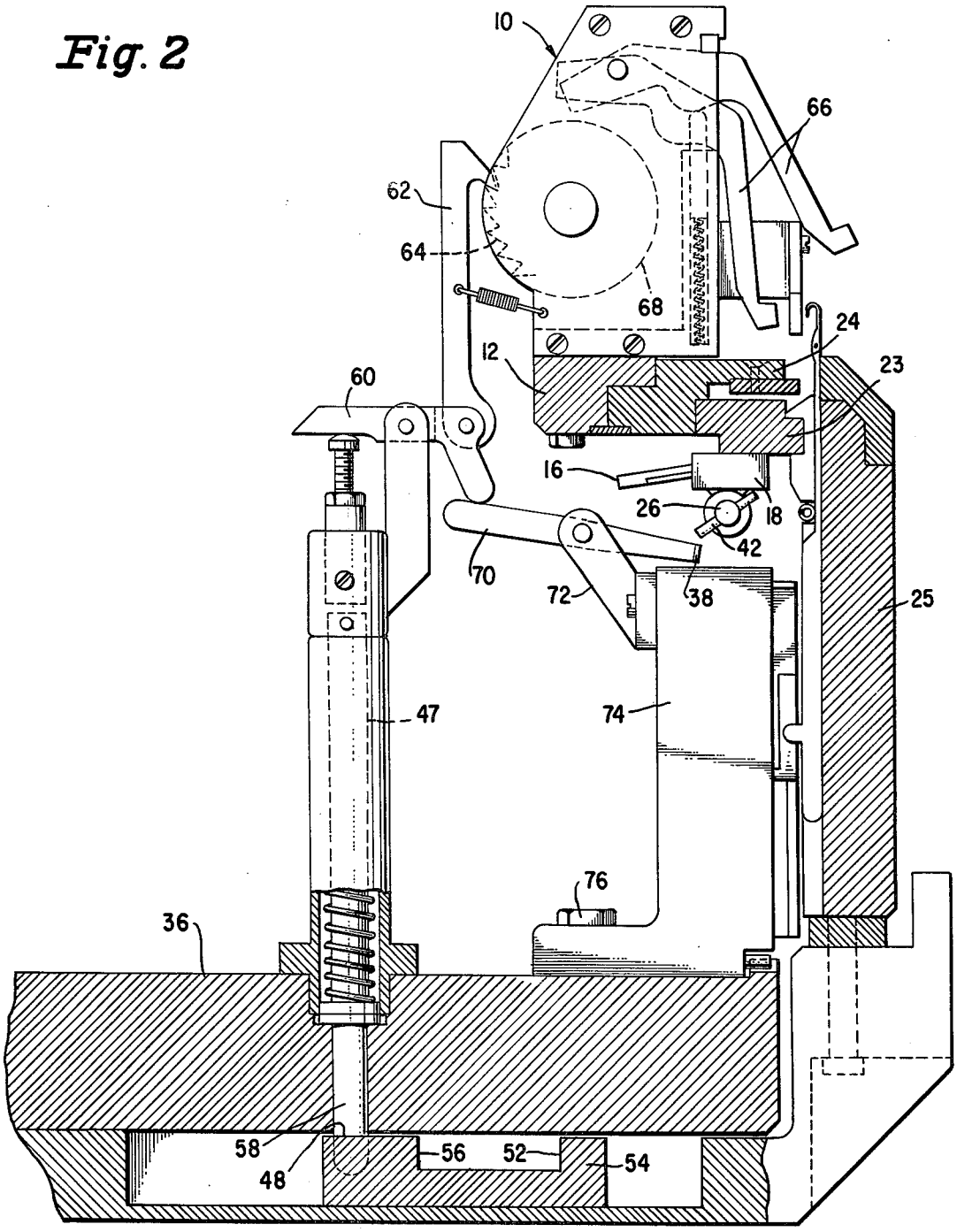
FIG. 2 is a vertical sectional view taken on the plane of the line 2—2 of FIG. 1.

Controlling mechanism for the yarn cutting and clamping device 14 includes a cam 16 pivotally mounted on a pin 17 in a member 18 (FIGS. 1, 6 and 8) which is secured at 20 and 22 to the underside of a sinker dial 23. As shown in FIG. 2, the sinker dial is located under a sinker cam ring 24 which is secured to ring 12. The sinker dial 23 and a needle cylinder 25 to which it is keyed are rotatable relative to the rings 12 and 24, and therefor to device 14 and striping box 10. Member 18 supports a rotatable shaft 26 having a pin 28 therein positionable by the shaft. In one position of the shaft 26, pin 28 is vertical (FIG. 11) and disposes cam 16 in a position to actuate an arm 29 and thereby pivotally attached wiper finger 30 of the yarn cutting and clamping device through links 31, 32 and 34, whereas, in another position of the shaft 26, pin 28 is at an angle to the vertical (FIG. 11*a*) and permits the pivoted cam 16 to assume a non-actuating position (see FIGS. 1, 3, 6, 11 and 11*a*).

Member 18, in addition to being rotatable with sinker dial 23 relative to ring 12 which supports striping box 10 and device 14, is rotatable relative to a cam retaining ring 36 having cams 38 and 40 located thereon as indicated in FIG. 1 for engaging a pin 42 in shaft 26 and rotating the shaft between positions corresponding to the vertical and the angular position of pin 28. Cam 38 is movable and may be disposed in or out of the path of pin 42 (FIGS. 2 and 9). When disposed in the path of pin 42, cam 38, upon engaging such pin, causes shaft 26 to be rotated to the position corresponding to the vertical position of pin 28. Cam 40 is always disposed for engagement with pin 42 (FIG. 10) and unless shaft 26 is already in a position corresponding to the angular position of pin 28 when pin 42 reaches cam 40, cam 40 engages the pin 42 causing shaft 26 to be rotated to the position corresponding to the said angular position of the pin 28. A ball check device including ball 43 engageable in recesses 44 and 45 in shaft 26 is provided for holding the shaft in the positions corresponding to the vertical and angular positions respectively of pin 28 (FIG. 7).

It should be understood that there would normally be a striping box at each yarn feeding station around the machine like the one striping box 10 shown in the drawings, that each striping box would be associated with a yarn cutting and clamping device like device 14, and that an arm 29 and attached wiper finger 30 on each device would be operable by linkages such as 31, 32 and 34 subject to actuation by pivoted cam 16. The striping box 10 shown in the drawings is at the first yarn feed of the machine downstream (that is in the direction of rotation of the needle cylinder 25 and sinker dial 23 relative to the sinker cam ring 24, striping box carrier ring 12, and cam retaining ring 36) from a pin 46 (FIG. 1) operable to predetermine the operation of striping box plungers such as plunger 47 of striping box 10. Cam 38 would be duplicated at each striping box around the machine but there is only one cam 40, the latter cam being located between the last and the first yarn feeding station on the machine.

A cam 48 (FIGS. 1, 2 and 5) which rotates with the cylinder of the machine is provided to sequentially actuate the striping box plungers. The cam is generally similar to and is controlled in the same manner as the plunger operating cam of U.S. Pat. No. 2,543,121 of S. Mishcon et al, for "Knitting Machine" issued Feb. 27, 1951. During each revolution of the cam, a pin 50 which is mounted in cam retaining ring 36 and is engageable with a camming surface 52 on a sliding block 54 of which the cam 48 is a part, causes cam 48 to be moved to a radially inward position if it is not already in such position. The cam 48 may then move past striping box plungers without actuating them. The cam, however, after being first moved radially inward by pin 50 may be moved to a radially outward plunger actuating position by the action of pin 46 on cam surface 56 of sliding block 54. Pin 46 is carried on an arm 57, the movements of which may be controlled as in the said U.S. Pat. No. 2,543,121, by mechanism responsive to the rotation of the cylinder including a timing chain which predetermines whether pin 46 is held in a position where it cannot engage cam surface 56 or is positioned to engage such cam surface and cause cam 48 to be moved to its radially outward position.

Cam 48 and ring 23 with member 18 thereon rotate together relative to rings 12, 24 and 36 and the circumferential location of cam 48 with respect to member 18 is such that the cam comes into radial alignment with plunger 47 during rotation of the cylinder before pin 42 reaches radial alignment with cam 38. Pin 42 and shaft 26 are in positions corresponding to the angular position of pin 28 when cam 48 comes into radial alignment with plunger 47, the pin 42 and shaft 26 having been so disposed by engagement of the pin 42 with cam 40.

Assuming cam 48 is in its radially outward plunger actuating position when the cam reaches plunger 47, the cam acting through pin 58 lifts the plunger 47 to pivot a link 60 and cause a pawl 62 to index a toothed wheel 64 of striping box 10 (FIG. 2). During such indexing, fingers 66 in the striping box are selectively operated by engagement with and disengagement from keys (not shown) in a drum 68 to change yarn fed to the needles of the machine.

At the same time, that link 60 operates pawl 62, it also pivots a link 70 on a bracket 72 to bring cam 38 into a position where it may engage pin 42. The bracket 72 is affixed to a cam section block 74 which is mounted at 76 on cam retaining ring 36 as shown. Engagement of pin 42 with cam 38 results in shaft 26 being rotated and pivoted cam 16 being raised by pin 28 from a position to miss link 31 of the actuating linkages for arm 29 and wiper finger 30 of the yarn cutting and clamping device 14 into an actuating position where it is retained until the completion of a revolution of the needle cylinder. Rotation of member 18 brings the raised cam 16 into engagement with link 31 and causes operation of the yarn cutting and clamping device 14.

Links 31 and 32 are affixed to a shaft 75 which is pivotally mounted in a member 76 secured at 78 and 80 to striping box carrier ring 12 (FIGS. 1 and 3). A torsion spring 81 having one end in engagement with member 76 and the other end in engagement with link 31 biases arm 29 of device 14 against a stop 84 to thereby determine the normal unactuated positions of the links 31, 32 and 34 connected thereto. However, when cam 16 engages link 31, arm 29 is moved away from stop 84 causing wiper finger 30 to be moved inwardly and through clamps 86 and 88 (FIG. 4) with any yarn positioned by a finger 66 of the striping box 10 for clamping and cutting. As the yarn is moved into the clamps, it is cut by the action of scissor member 90 connected by link 92 to arm 29. When pivoted cam 16 passes beyond link 31, spring 81 causes links 31, 32 and 34 to assume their normal positions and arm 29 pulls the pivoted wiper finger 30 outwardly and over the clamps 86 and 88 biasing a spring which normally maintains the wiper finger in the position shown in FIG. 3.

Other yarn clamping and cutting devices function in the same manner as described for device 14. When a complete revolution by member 18 has been completed and pin 42 comes abreast of cam 40, the pin is engaged by the cam and shaft 26 is caused to move pin 28 away from the vertical whereupon pivoted cam 16 assumes its unactuating position.

Although the invention has been described in its preferred form, with a certain degree of particularity, it is to be understood that the present disclosure of the preferred form has been made by way of example only and that changes in the details of construction and arrangement of parts may be resorted to without departing from the spirit and scope of the invention.

Having thus described the nature of the invention, what is claimed herein is:

1. In a circular knitting machine, the combination comprising a striping box and an associated yarn cutting and clamping device including clamps and a wiper finger, linkage means operably connected to said wiper finger for at times moving said wiper finger inwardly and through said clamps, a pivoted cam rotatable relative to said linkage means, first cam means for disposing said pivoted cam in an actuating position to operate said linkage means and thereby cause said wiper finger to be moved inwardly and through said clamps, a pivoted link supporting said first cam means on one end thereof, and means operable with the other end of said pivoted link for moving said first cam means and to thereby move said pivoted cam into said actuating position, spring means for causing said wiper finger to be moved outwardly and over said clamps, and second cam means for causing said pivoted cam to move into a non-actuating position wherein said linkage means is not operated by said pivoted cam.

2. The combination of claim 1, wherein said means operable with the other end of said pivoted link includes an actuating plunger for said striping box.

3. The combination of claim 1, wherein said second cam means supported in a fixed position on said machine.

* * * * *